US007731000B2

(12) United States Patent
Oh et al.

(10) Patent No.: US 7,731,000 B2
(45) **Date of Patent: *Jun. 8, 2010**

(54) ROLL-CALLING MECHANISM BASED VISION SYSTEM FOR ELEVATOR POSITIONING

(75) Inventors: Jae-Hyuk Oh, Tolland, CT (US); Alan M. Finn, Hebron, CT (US); Pei-Yuan Peng, Ellington, CT (US); Norbert A. M. Hootsmans, S. Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 784 days.

This patent is subject to a terminal disclaimer.

(21) Appl. No.: 10/590,682

(22) PCT Filed: Feb. 27, 2004

(86) PCT No.: PCT/US2004/005906

§ 371 (c)(1),
(2), (4) Date: Aug. 25, 2006

(87) PCT Pub. No.: WO2005/092765

PCT Pub. Date: Oct. 6, 2005

(65) Prior Publication Data

US 2008/0193138 A1 Aug. 14, 2008

(51) Int. Cl.
*B66B 1/34* (2006.01)

(52) U.S. Cl. ..... 187/394

(58) Field of Classification Search ..... 187/247, 187/248, 391–394, 413, 414
See application file for complete search history.

(56) References Cited

U.S. PATENT DOCUMENTS

| | | | | | |
|---|---|---|---|---|---|
| 3,414,088 | A | * | 12/1968 | Bruns et al. | 187/389 |
| 4,134,476 | A | * | 1/1979 | Zolnerovich et al. | 187/394 |
| 4,375,057 | A | * | 2/1983 | Weise et al. | 187/394 |
| 4,473,133 | A | | 9/1984 | Enriquez et al. | |
| 4,674,604 | A | * | 6/1987 | Williams | 187/291 |

(Continued)

FOREIGN PATENT DOCUMENTS

DE 622738 12/1935

(Continued)

OTHER PUBLICATIONS

German patent application 11 2004 002 766.7-22; Office Action dated Jan. 11, 2008.

(Continued)

*Primary Examiner*—Jonathan Salata
(74) *Attorney, Agent, or Firm*—Bachman & LaPointe, P.C.

(57) ABSTRACT

A positioning system having a plurality of transponder modules each located at a known location for receiving an electromagnetic signal and emitting a light signal, at least one transceiver module for emitting an electromagnetic signal and receiving the light signal, and apparatus processing the received light signal to determine a position of the at least one transceiver module.

11 Claims, 1 Drawing Sheet

U.S. PATENT DOCUMENTS

| | | | | | |
|---|---|---|---|---|---|
| 4,732,238 | A | * | 3/1988 | Baumgartner | 187/317 |
| 5,223,680 | A | * | 6/1993 | Schmidt-Milkau et al. | 187/394 |
| 5,306,882 | A | * | 4/1994 | Gerwing et al. | 187/394 |
| 5,677,519 | A | * | 10/1997 | Herkel et al. | 187/291 |
| 5,682,024 | A | * | 10/1997 | Koopman et al. | 187/394 |
| 5,736,695 | A | * | 4/1998 | Hoepken | 187/394 |
| 5,831,227 | A | * | 11/1998 | Finn et al. | 187/394 |
| 5,883,345 | A | * | 3/1999 | Schonauer et al. | 187/394 |
| 5,889,239 | A | * | 3/1999 | Blackaby et al. | 187/391 |
| 6,554,107 | B2 | | 4/2003 | Yumura et al. | |
| 6,601,679 | B2 | | 8/2003 | Crenella et al. | |
| 6,612,403 | B2 | * | 9/2003 | Silberhorn et al. | 187/394 |
| 2007/0084675 | A1 | * | 4/2007 | Kang et al. | 187/394 |

FOREIGN PATENT DOCUMENTS

| | | | | |
|---|---|---|---|---|
| EP | 0757011 | A2 | | 5/1997 |
| EP | 1232988 | A1 | | 6/2008 |
| JP | 02295866 | A | * | 12/1990 |

OTHER PUBLICATIONS

English translation of German patent application 11 2004 002 766. 7-22; Office Action dated Jan. 11, 2008.

* cited by examiner

ROLL-CALLING MECHANISM BASED VISION SYSTEM FOR ELEVATOR POSITIONING

BACKGROUND OF THE INVENTION (1) Field of the Invention

The invention relates to an apparatus, and method for establishing the position of a moving platform.

(2) Description of the Related Art

A positioning reference system (PRS) is a component of an elevator control system that provides fast and accurate position measurement of an elevator car in a hoistway. Some PRSs make use of vision based systems, such as charge couple devices (CCD) attached to a moving platform, in conjunction with visual indicators attached to fixed positions along a hoistway. Under such a scenario, the vision system observes the visual indicators, typically passive reflectors, identifies the location of the visual indicator, and computes a position of the movable platform therefrom.

Unfortunately, the signal to noise (S/N) ratio of CCD based vision systems employing passive reflectors can be substantially degraded due to opaque materials in the air, on the CCD lens, and/or on the passive reflectors. Such a degraded S/N ratio can lead to degradation of positioning performance of the CCD based PRSs in a worst case scenario. Use of a high intensity light illumination source for the visual indicator can form a satisfactory solution for preventing such performance degradation. Another solution involves the utilization of active reflectors, specifically reflectors which do not necessarily passively reflect light but which actively perform as a light source and are comprised, for example, of light omitting diodes (LEDs) instead of passive reflectors as noted above. Use of active reflectors is often times preferable as an active reflector can provide the necessary signal to noise ratio by controlling the intensity of the light emitted. Specifically in instances wherein power is available where the active reflectors are to be located, use of active reflectors forms methodology by which the S/N ratio may be increased to suitable levels for allowing accurate positioning of the movable platform.

However, there exist several critical problems associated with active reflector based CCD systems. First, the lifespan of an active reflector is limited as the longest lifespan of existing light sources is at most ten years. Increases in the ten year lifespan may be achieved by turning on and off the light sources comprising the active reflectors such that each light source is illuminated for only a few milliseconds out of every ten milliseconds. However, in the case of active reflectors, the only opportunity to turn off the active reflectors is when the elevator is not serving passengers, a duration of which cannot be clearly ascertained. In addition, turning on and off active reflectors in the above-noted fashion requires additional control/signal wirings which in turn increase the cost of installation.

Second, in order to endow a PRS with the capability of not requiring a correction run, the active reflectors are preferably encoded. Such encoding usually results in higher cost and less robust operation. These facts, coupled with the limited lifespan of active reflectors, leads to a high maintenance cost as well as a high material and installation cost.

What is therefore needed is a PRS which incorporates active reflectors in such a manner as to allow for a substantially longer lifespan of operation, while providing low cost installation and maintenance.

SUMMARY OF THE INVENTION

Accordingly, it is an object of the present invention to provide an apparatus, and method for establishing the position of a moving platform.

In accordance with the present invention, a positioning system comprises a plurality of transponder modules each located at a known location for receiving an electromagnetic signal and emitting a light signal, at least one transceiver module for emitting an electromagnetic signal and receiving the light signal, and means for processing the received light signal to determine a position of the at least one transceiver module. In the present invention the use of light broadly comprises electromagnetic radiation both in the human visible spectrum and in the infrared and ultraviolet spectrums.

In further accordance with the present invention, an apparatus for measuring a position of a movable platform comprises a plurality of transponder modules comprising an RF receiver for receiving an RF signal, and an array of lights for emitting a light signal, at least one transceiver module affixed to the movable platform comprising an RF transmitter for transmitting a coded RF signal, a camera for receiving the light signal, and a processing unit for identifying a position of one of the plurality of transponder from the received light signal and computing a position of the movable platform.

In further accordance with the present invention, a method for measuring a position of a moveable platform comprises the steps of affixing at least one transceiver module to the moveable platform the transceiver module comprising an RF transmitter for transmitting an RF signal, a camera for receiving a light signal, and a processing unit for identifying a position of the received light signal and computing a position of the movable platform, disposing a plurality of each at a fixed position the transponder modules comprising an RF receiver for receiving a coded RF signal, and an array of lights for emitting a light signal, emitting from the at least one transceiver module a coded RF signal for receipt by one of the plurality of transponder modules, receiving the coded RF signal by one of the plurality of the transponder modules and emitting a light signal in response thereto, receiving the emitted light signal with the camera device of the at least one transceiver module, and computing a position of the transceiver module from the received light signal.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

The present invention is a position reference system (PRS) for use in determining the position of a moving platform. The PRS of the present invention makes use of a series of transponder modules affixed along a fixed path and at least one transceiver module attached to a moving platform. The moveable platform is typically likewise capable of moving along such a fixed path. While described with respect to platforms that move along a fixed path, the present invention is not so restricted. Each transponder module is comprised of an RF receiver and a light emitting array. Conversely, each transceiver module comprises an RF emitter and a camera device for recording the light emitted from each transponder module's light emitting array. As a result, the RF emitter of each transceiver module is configured to emit an RF signal for receipt by one or more transponder modules. Upon receipt of the RF signal by a transponder module, the light emitting array is activated for a brief period of time. The emitted light is captured by the camera device of each transceiver module. Because each transponder module, and by extension each light emitting array, is located in a fixed and known position, it is possible upon receipt from the light emitting array for each transceiver module to visually inspect and thereby deduce the position of the transceiver module with respect to the light emitting array. A computation may then be performed so as to correlate the position of the light emitting array within the field of view of the transceiver module to an offset of the transceiver module from the light emitting transponder module. There may then be calculated the position of the transceiver module relative to the transponder module, and, knowing the absolute position of the transponder module, the absolute position of the transceiver module with respect to the platform, and hence, the absolute position of the movable platform to which the transceiver module is affixed. While described with reference to elevators, the present invention is not so limited. Rather the present invention is drawn broadly to encompass any movable platform where the possible paths are comprised of known reference points, the spatial relationship to which is to be determined.

Figure 1:
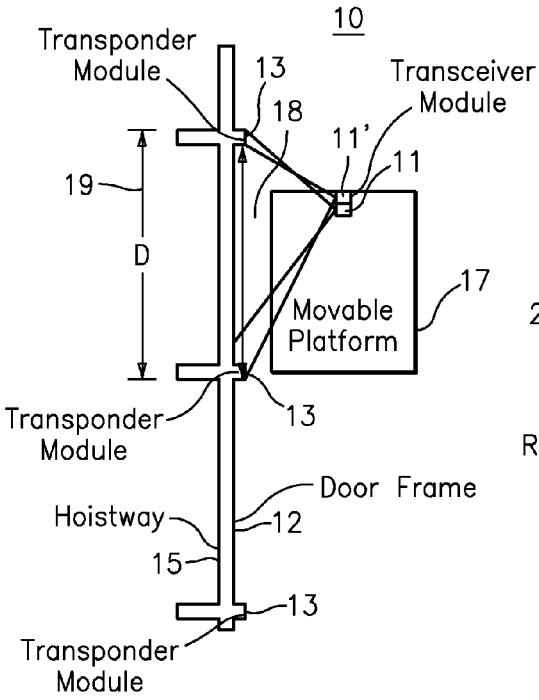
FIG. 1 A diagram of the position reference system (PRS) of the present invention.

With reference to FIG. 1, there is illustrated the position reference system (PRS) 10 of the present invention. Numerous transponder modules 13 are affixed to and situated along hoistway 15. In one embodiment, a single transponder module 13 is affixed one per floor along hoistway 15 whereby the position of each transponder module 13 in relationship to each doorframe 12 is identical or nearly identical. At least one transceiver module 11 is attached to movable platform 17.

Figure 2:
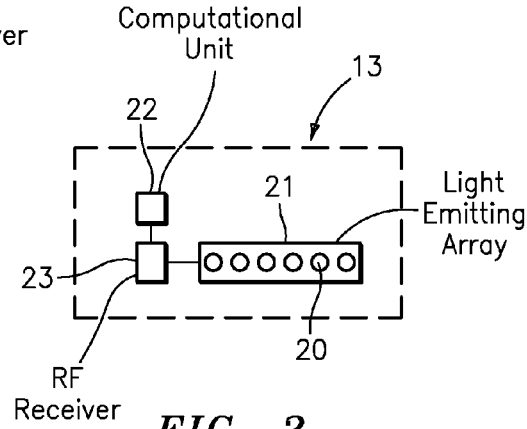
FIG. 2 A diagram of a transponder module of the present invention.

With reference to FIG. 2, there is illustrated in more detail a composition of a transponder module 13. Each transponder module 13 is composed of an RF receiver 23, a light emitting array 21, and a computational unit 22. RF receiver 23 is capable of receiving RF signals. Light emitting array 21 is preferably an array comprised of light emitting diodes (LED) 20. In a preferred embodiment, light emitting array 21 comprises a one dimensional array of LEDs. In yet another embodiment, light emitting array 21 may consist of a two dimensional array of LEDs or other light sources. As noted above, each transponder module 13 is installed in an identical, or nearly identical position with relationship to each doorframe 12. When an RF receiver 23 receives a coded RF signal from a transceiver module 11, RF receiver 23 demodulates the coded RF signal to extract a code, and sends the code to computational unit 22. The modulated code is compared by the computational unit 22 with a unique ID number stored in the computational unit 22. In a preferred embodiment, each individual transponder module 13 has an ID unique to it which is stored in computational unit 22. The unique ID may be imparted to transponder module 13 at its time of construction or dynamically allocated at a later time such as during installation. If the code extracted by RF receiver 23 from the RF encoded signal is found by computational unit 22 to be identical to the transponder module's 13 unique ID number, computational unit 22 instructs the light emitting array to turn on and then to turn off at a predetermined time. In a preferred embodiment, the computational unit 22, at the time of instructing light emitting array 21 to turn on, additionally communicates an intensity value. Intensity value controls the intensity of the light emitted from light emitting array 21. Preferably, this intensity value is encoded within the RF signal received from a transceiver module 11. In addition to merely turning on and off, the light emitting array 21 can be modulated to convey additional information. For example, in the instance in which light emitting array 21 is a one dimensional array of LEDs, individual LEDs may be turned on or off to convey binary coded information. Such binary coded information may include, but is not limited to, a representation of the unique ID code of the transponder module 13 of which light emitting array 21 forms a part.

Figure 3:
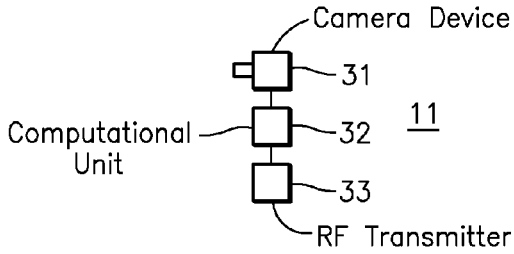
FIG. 3 A diagram of a transceiver module of the present invention.

With reference to FIG. 3, there is illustrated in detail the construction of each transceiver module 11. Each transceiver module 11 consists of an RF transmitter 33, a camera device 31, and a computational unit 32. To increase the viewing angle of each camera device 31, the transceiver module 11 is typically installed on the side of the movable platform 17. In the instance where a movable platform 17 is an elevator, transceiver module 11 is affixed to the movable platform 17 in such a way that a clear view of each light emitting array 21 is not blocked by either the side of the elevator 17 or the walls comprising the hoistway 15. The transceiver module 11 is capable of viewing each light emitting array as the movable platform 17 to which transceiver module 11 is affixed moves past a particular transponder module 13. In a preferred embodiment, camera device 31 of transceiver module 11 is a solid-state device such as a complementary metal oxide semiconductor (CMOS) device or charged coupled device (CCD). CCDs typically have a field of view 18 which extends at approximately a 60° angle, or 30° either side of center, out and away from camera device 31. As a result, the field of view 18 of a camera device 31 spans an observable range D along a hoistway 15. It is preferred that the observable range D of each camera device 31 be greater than the distance separating each adjacent transponder module 13. In this manner, camera device 31 of the transceiver module 11 is always able to view at least one transponder module 13.

In normal operation, the transceiver module 11 transmits a coded message to be received by the transponder module 13 closest to the transceiver module 11. Computational unit 32 has stored within it, or has otherwise access to, the unique ID of each transponder module as well as its corresponding position. Except in cases of power failure, the PRS of the present invention can ascertain both the position of the cab and the nearest transponder module 13, and is therefore able to specifically call the desired transponder module 13 closest to transceiver module 11. Once the transceiver module 11 issues the coded signal to the transponder module 13, the camera device 31 of the transceiver module 11 receives photons emanating from the light emitting array 21 of the transponder module 13. Upon receipt of the light emitted from the light emitting array 21, computational unit 32 computes the position of the transceiver module 11, and by extension the position of the movable platform as described above. This operation is repeated at regular time intervals. In a preferred embodiment, the time interval between the sending of coded messages by transceiver module 11 attached to movable platform 17 is preferably between 1 and 100 milliseconds, most preferably approximately 10 milliseconds. Therefore, in normal operation, the transceiver module 11 is capable of ascertaining the position of the movable platform 17 at approximately 10 milliseconds in the past and the unique ID of each transponder module 13. The transceiver module 11 then sends a coded RF signal to the nearest transponder module 13. The transponder module 13 listens for the incoming RF signal, decodes the incoming RF signal, and compares the code to its unique ID. If the code is identical to its ID, the transponder module 13 triggers the light emitting array with an intensity command indicating the intensity at which the light emitting array is to operate. The transceiver module 11 detects the light signal emitted from light emitting array 21. As noted above, the computing unit has access to the position of each transponder module 13. The computing unit 32 computes the position of the light emitting array 21 of a transponder module 13 with respect to the camera device 31 based upon the position of the light emitting array in the field of view 18 of the camera device 31, and computes an absolute position of camera device 31, and hence by extension, the position of movable platform 17.

In an alternative embodiment, two transceiver modules 11, 11' are affixed to movable platform 17 such that their respective field of use 18 overlap to cover a wider observable range 19. In the case of elevators, such redundancy of transceiver modules 11 is performed to increase the safety with which one may be assured that at least one transceiver module 11 is capable of observing a light emitting array 21 at any given moment.

In the instance of a power failure, the transceiver module 11 of the present invention calls, in serial fashion, each of the unique IDs corresponding to the transponder modules 13 located along a hoistway 15. Transceiver module 11 continues to call each ID in a sequence until the camera device 31 of the transceiver module 11 detects light emitted from the light emitting array 21. At such a time, transceiver module 11, knowing as it does the location associated with each individual transponder module 13, may compute the absolute position of transceiver module 11.

In an alternative embodiment, in addition to having access to its own unique ID code, each transponder module 13 is assigned a universal registration code. This universal registration code is the same for each transponder module 13. In the event that a transponder module 13 decodes a message wherein the decoded code is equivalent to the universal registration code, transponder module 13 instructs the light emitting array 21 to turn on and off the individual lights comprising the light emitting array 21 in such a sequence as to indicate the unique coded ID of the individual transponder module 13. In a preferred embodiment, the lights are turned on in a sequence representing a binary code. In this manner, a transponder module 13 may be installed as a replacement to an existing transponder module 13 at a known location and may transmit its unique ID to transceiver module 11 for storage within computational unit 32 during operation.

One or more embodiments of the present invention have been described. Nevertheless, it will be understood that various modifications may be made without departing from the spirit and scope of the invention. Accordingly, other embodiments are within the scope of the following claims.

What is claimed is:

1. A positioning system comprising:

a plurality of transponder modules each located at a known location for receiving an electromagnetic signal and emitting a light signal;

at least one transceiver module for emitting said electromagnetic signal and receiving said light signal; and means for processing said received light signal to determine a position of said at least one transceiver module.

2. The positioning system of claim 1 wherein said at least one transceiver module is affixed to a movable platform.

3. The positioning system of claim 2 wherein said movable platform is an elevator.

4. The positioning system of claim 1 wherein said electromagnetic signal is an RF signal.

5. The positioning system of claim 1 wherein each of said transponder modules comprises an array of lights selected from the group consisting of a one-dimensional array and a two-dimensional array.

6. The positioning system of claim 5 wherein said array of lights comprises an array of light emitting diodes (LEDs).

7. An apparatus for measuring a position of a movable platform comprising:

a plurality of transponder modules each comprising:

an RF receiver for receiving an RF signal; and an array of lights for emitting a light signal;

at least one transceiver module affixed to said movable platform comprising:

an RF transmitter for transmitting a coded RF signal;

a camera for receiving said light signal; and a processing unit for identifying a position of one of said plurality of transponders from said received light signal and computing a position of said movable platform.

8. A method for measuring a position of a moveable platform comprising the steps of:

affixing at least one transceiver module to said moveable platform said transceiver module comprising:

an RF transmitter for transmitting a coded RF signal;

a camera for receiving a light signal; and a processing unit for identifying a position of said received light signal and computing a position of said movable platform;

disposing a plurality of transponder modules each at a fixed position said transponder modules comprising:

an RF receiver for receiving a coded RF signal; and an array of lights for emitting a light signal;

emitting from said at least one transceiver module a coded RF signal for receipt by one of said plurality of transponder modules;

receiving said coded RF signal by one of said plurality of said transponder modules and emitting a light signal in response thereto;

receiving said emitted light signal with said camera device of said at least one transceiver module; and computing a position of said transceiver module from said received light signal.

9. The method of claim 8 wherein said receiving said coded RF signal comprises the additional steps of:

decoding said coded RF signal to obtain a code;

comparing said code to a unique ID; and activating said array of lights when said unique ID is the same as said code.

10. The method of claim 8 wherein said receiving said coded RF signal comprises the additional steps of:

decoding said coded RF signal to obtain a universal registration code; and activating said array of lights.

11. The method of claim 10 wherein said activating said array of lights comprises activating said array of lights to transmit a unique ID as a binary code.

* * * * *